US008662352B1

(12) United States Patent
des Jardins et al.

(10) Patent No.: US 8,662,352 B1
(45) Date of Patent: Mar. 4, 2014

(54) FLUID DISPENSER AND METHOD FOR DISPENSING A FLUID INCLUDING A UNIFORM DISTRIBUTION OF COMPOSITE MATERIALS

(71) Applicant: Nordson Corporation, Westlake, OH (US)

(72) Inventors: Stephen R. des Jardins, Encinitas, CA (US); William MacIndoe, Exeter, RI (US); Robert W. Springhorn, Cream Ridge, NJ (US)

(73) Assignee: Nordson Corporation, Westlake, OH (US)

( * ) Notice: Subject to any disclaimer, the term of this patent is extended or adjusted under 35 U.S.C. 154(b) by 0 days.

(21) Appl. No.: 13/662,799

(22) Filed: Oct. 29, 2012

(51) Int. Cl.
*B67D 7/84* (2010.01)

(52) U.S. Cl.
USPC ..... 222/167; 222/168; 222/160; 222/389; 222/1; 366/220; 251/129.15; 251/176; 128/DIG. 1

(58) Field of Classification Search
USPC ..... 222/167, 251, 319, 329, 342, 394, 420, 222/519–521, 74, 180, 182, 63, 160, 168, 222/389, 504, 226, 227; 366/220; 604/131, 604/65–67; 433/89, 90, 84, 85; 128/DIG. 1
See application file for complete search history.

(56) References Cited

U.S. PATENT DOCUMENTS

| | | | | |
|---|---|---|---|---|
| 4,942,984 | A | 7/1990 | Miller | |
| 5,747,102 | A * | 5/1998 | Smith et al. | 427/98.4 |
| 5,887,764 | A * | 3/1999 | Ennis et al. | 222/389 |
| 5,992,688 | A * | 11/1999 | Lewis et al. | 222/1 |
| 6,253,957 | B1 * | 7/2001 | Messerly et al. | 222/1 |
| 6,257,444 | B1 * | 7/2001 | Everett | 222/1 |
| 6,270,019 | B1 * | 8/2001 | Reighard | 239/1 |
| 6,504,301 | B1 | 1/2003 | Lowery | |
| 6,575,930 | B1 | 6/2003 | Trombley, III et al. | |
| 6,715,506 | B1 * | 4/2004 | Ikushima | 137/14 |
| 7,448,653 | B2 | 11/2008 | Jensen et al. | |
| 7,617,953 | B2 | 11/2009 | Tourigny | |
| 7,726,516 | B2 * | 6/2010 | Engel | 222/63 |
| 7,762,088 | B2 * | 7/2010 | Fiske et al. | 62/3.64 |
| 7,980,197 | B2 * | 7/2011 | Prentice et al. | 118/688 |
| 7,998,526 | B2 | 8/2011 | Xu et al. | |
| 8,302,821 | B2 * | 11/2012 | Inaba et al. | 222/261 |
| 8,448,818 | B2 * | 5/2013 | Ikushima | 222/1 |
| 2006/0278666 | A1 * | 12/2006 | Wang et al. | 222/504 |
| 2007/0145164 | A1 * | 6/2007 | Ahmadi et al. | 239/583 |
| 2009/0095825 | A1 * | 4/2009 | Ahmadi et al. | 239/583 |
| 2009/0101669 | A1 * | 4/2009 | Hassler et al. | 222/1 |
| 2013/0233891 | A1 * | 9/2013 | Ikushima | 222/309 |

* cited by examiner

*Primary Examiner* — Kevin P Shaver
*Assistant Examiner* — Michael J Melaragno
(74) *Attorney, Agent, or Firm* — Wood, Herron & Evans, L.L.P.

(57) ABSTRACT

A fluid dispenser and a method for using the fluid dispenser with a syringe barrel holding a fluid including a distribution of composite materials. The fluid dispenser includes a dispensing valve operable to dispense the fluid and a coupling for fluidly connecting the syringe barrel to the dispensing valve. The fluid dispenser also includes a support frame for rotatably supporting the syringe barrel and a motorized drive unit configured to rotate the syringe barrel. The syringe barrel rotates via the motorized drive unit to distribute the composite materials uniformly within the fluid for dispensing the fluid.

21 Claims, 10 Drawing Sheets

FLUID DISPENSER AND METHOD FOR DISPENSING A FLUID INCLUDING A UNIFORM DISTRIBUTION OF COMPOSITE MATERIALS

TECHNICAL FIELD

The present invention relates generally to a fluid dispenser and a method for dispensing a fluid, and more particularly, to a fluid dispenser and method for dispensing a fluid for use with a syringe barrel holding a fluid including a distribution of composite materials.

BACKGROUND

Fluid dispensers having various types of dispensing valves for use with syringe barrel fluid supply reservoirs are generally well known in the field of fluid dispensing. The applications for the fluid dispensers vary widely, and, as such, so do the fluids held within the syringe barrels. These fluids may comprise single-component fluids or multi-component fluids, such as a fluid comprising composite materials. The composite materials may include any combination of fluid materials and/or particulate materials. The composite materials preferably have uniformly mixed concentrations rather than variable concentrations. A uniform concentration is preferable to variable concentrations because multi-component fluids are typically mixed to provide specific, consistent material properties in use. Unmixed fluids, on the other hand, have variable component concentrations that dispense from the fluid dispenser having variable material properties, which either create unacceptable variation in the final product or cause the fluid to be unusable for its intended purpose.

Multi-component fluids may include composite materials comprised of relatively heavily weighted particles suspended within a lightly weighted component fluid or multiple fluids having different densities. As such, these multi-component fluids tend to separate or settle over time due to the effects of gravity. This settling may occur before or even during the use of the syringe barrel with the fluid dispenser. For example, a syringe barrel may hold fluid silicone encapsulent fluid including fluorescent particulate material for use in the production of light emitting diodes (LEDs). The fluorescent material particulates are heavier than the fluid silicone encapsulent, which, due to the effects of gravity, cause the fluorescent material to settle out of the silicone encapsulent fluid. Thus, the resulting fluid/particulate mixture has an increasingly variable concentration over time. As the fluid/particulate mixture is dispensed, the particulate concentrations in the fluid mixture may vary with each application. As one example, this effect may create color variation in the light produced by the LEDs manufactured over that period of production.

Presently, manufacturers dispensing multi-component fluids prone to settling may actively distribute the components uniformly prior to installing the syringe barrel within the fluid dispenser. In this manner, the negative effects of component settling may be averted upon initial dispensing of the fluid from the fluid valve. This step adds time and cost to the dispensing process. Moreover, multi-component fluids, settling or separation of the separate components may still occur after initial dispensing. This creates a limited time period for dispensing fluid with a uniform concentration of components. In the event that the syringe barrel is not effectively emptied during that limited time period, the manufacturer must either dispose of the remaining fluid or remove the syringe barrel to once again actively distribute the remaining fluid to a uniform concentration.

There is a need for a fluid dispenser and method for dispensing a fluid having composite materials that addresses present challenges and characteristics such as those discussed above.

SUMMARY

In one embodiment, the invention provides a fluid dispenser for use with a syringe barrel holding a fluid including a distribution of composite materials. The fluid dispenser generally includes a dispensing valve operable to dispense the fluid, a coupling, a support frame, and a motorized drive unit. The coupling is connected to the dispensing valve for fluidly connecting the syringe barrel with the dispensing valve. The support frame of the fluid dispenser is for rotatably supporting the syringe barrel generally adjacent to the dispensing valve in a generally horizontal orientation so as to align the syringe barrel with the coupling. Furthermore, the motorized drive unit is configured to rotate the syringe barrel to distribute the composite materials uniformly within the fluid.

In one aspect, the coupling has a stationary portion and a pivot portion. The stationary portion is fixedly connected to the dispensing valve, and the pivot portion is for being fixedly connected to the syringe barrel. Moreover, the pivot portion is rotatably relative to the stationary portion for coupling the rotatably supported syringe barrel to the dispensing valve.

In another aspect, the support frame is affixed to the dispensing valve and extends therefrom. The support frame is also adjustable relative to the dispensing valve for accommodating syringe barrels of variable size. The support frame generally includes a primary support member operatively affixed to the dispensing valve, a barrel support member, and a motor support member. The barrel support member is adjustably mounted to the primary support member and configured to support the syringe barrel. The motor support member is also adjustably mounted to the primary support member with the motorized drive unit being mounted to the motor support member. Furthermore, the barrel support member and the motor support member are longitudinally adjustable along the primary support member for accommodating syringe barrels of various size.

Various additional aspects of the fluid dispenser include a driving member attached to the motorized drive unit and a driven member for attaching to the syringe barrel. The driven member operatively engages the drive member for rotating the syringe barrel and maintaining the suspension of the particulates within the fluid. The motorized drive unit is also adjustable relative to the dispensing valve for accommodating syringe barrels of variable size.

Furthermore, the composite material includes a relatively high density material and a relatively low density material. The fluid dispenser further includes a control unit operatively connected to the motorized drive unit. The control unit directs the motorized drive unit to rotate the syringe barrel in periodic intervals to promote the uniform distribution of the high and low density materials under the influence of gravity. The rotation may be periodic in the counterclockwise direction, the clockwise direction, or any combination thereof for distributing the high and low density materials uniformly.

As to using an embodiment of the invention, the syringe barrel is coupled to the dispensing valve such that the syringe barrel and the dispensing valve are in fluid communication. The syringe barrel is also rotatably mounted on the support frame and is in a generally horizontal orientation. Furthermore, the syringe barrel is rotated via the motorized drive unit to distribute the composite materials uniformly within the fluid. The fluid, which includes the uniform distribution of composite materials, is dispensed from the fluid dispenser.

In addition, the syringe barrel may be rotated periodically. The rotation may be in any direction such as the counterclockwise direction, the clockwise direction, or any combination thereof. For example, the syringe barrel may be rotated back and forth between the counterclockwise direction and the clockwise direction in periodic intervals or rotated in one direction in periodic intervals.

Various additional objectives, advantages, and features of the invention will be appreciated from a review of the following detailed description of the illustrative embodiments taken in conjunction with the accompanying drawings.

BRIEF DESCRIPTION OF THE DRAWINGS

The accompanying drawings, which are incorporated in and constitute a part of this specification, illustrate embodiments of the invention and, together with a general description of the invention given above, and the detailed description given below, serve to explain the invention.

DETAILED DESCRIPTION

Figure 1:
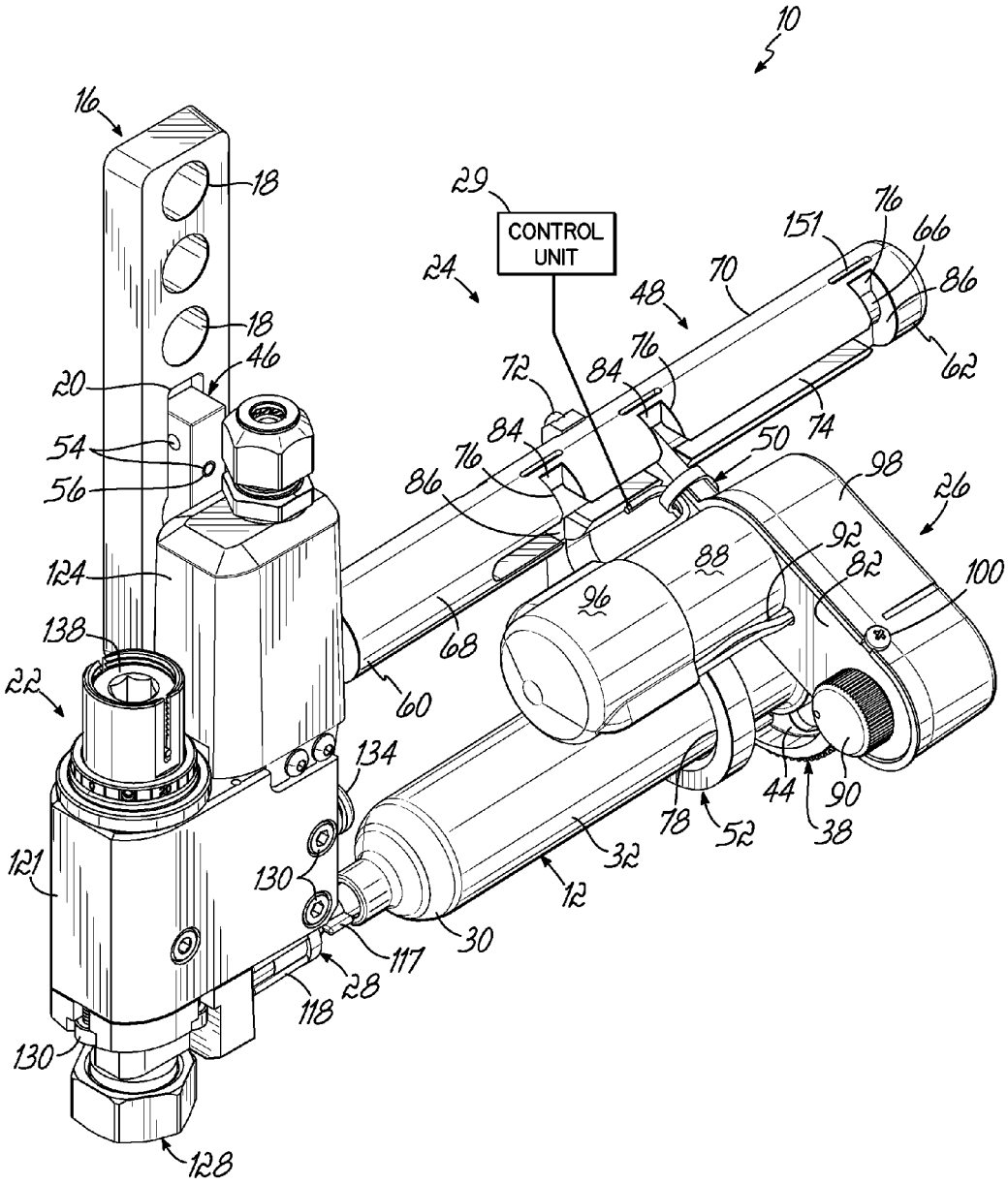
FIG. 1 is a front perspective view of a fluid dispenser for use with a syringe barrel holding a fluid including a distribution of composite materials according to one embodiment of the invention.

With reference to FIG. 1, an embodiment of the fluid dispenser 10 for use with a syringe barrel 12 holding a fluid 14 (see FIG. 4) including a distribution of composite materials, is mounted to a frame member 16. The composite materials for use with the exemplary embodiment of the invention may be two or more liquids of different density or different type, or one or more liquids including a suspension of particulates having different densities. The frame member 16 further includes frame bores 18 for reducing the weight of the frame member 16 and a mounting slot 20 into which the fluid dispenser 10 is mounted. It will be appreciated, however, that the frame member 16 generally represents any frame or similar structure to which the fluid dispenser 10 may be mounted in order to rigidly affix the fluid dispenser 10 sufficiently for dispensing the fluid 14. For example, the frame member 16 may be mounted to any structure, such as a robot (not shown), for selectively engaging and moving the fluid dispenser 10 or integrated as part of an automated system comprising the fluid dispenser 10.

The fluid dispenser 10 generally includes a dispensing valve 22 operable to dispense the fluid 14, a support frame 24, a motorized drive unit 26, and a coupling 28 connected to the dispensing valve 22 for fluidly connecting the syringe barrel 12 with the dispensing valve 22. As shown in FIG. 1, the dispensing valve 22 is rigidly affixed to the support frame 24. More particularly, the support frame 24 extends generally longitudinally from the dispensing valve 22. However, the dispensing valve 22 may alternatively be fixedly positioned relative to the support frame 24 by way of differing frame members or equivalent structure so that the dispensing valve 22 and the support frame 24 are sufficiently positioned for operatively accommodating the syringe barrel 12. While the exemplary embodiment of the invention accommodates one syringe barrel 12, a cartridge (not shown) including a plurality of the syringe barrels 12 may also be used according the principles of this invention. Accordingly, the invention is not intended to be limited to use with one syringe barrel 12.

The support frame 24 rotatably supports the syringe barrel 12 generally adjacent to the coupling 28 for fluidly connecting and rotatably coupling the syringe barrel 12 to the dispensing valve 22. As shown in FIG. 1, the syringe barrel 12 extends generally longitudinally from the coupling 28. More specifically, the syringe barrel 12 is oriented generally when supported by the support frame 24 to be aligned and coupled with the coupling 28. Furthermore, the support frame 24 is adjustable relative to the dispensing valve 22 for accommodating syringe barrels 12 of variable size and volume. For instance, such variable sizes include, but are not limited to, 10 cc syringe barrels, 30 cc syringe barrels, and 55 cc syringe barrels.

The motorized drive unit 26 is configured to rotate the syringe barrel 12 that is rotatably mounted to the support frame 24. As such, the motorized drive unit 26 operatively engages the syringe barrel 12 for rotating the syringe barrel 12 to distribute the composite materials uniformly within the fluid 14 and maintain the uniform distribution of composite materials within the fluid 14. According to the present embodiment of the invention, the syringe barrel 12 is rotated in periodic intervals for a predetermined amount of rotation. However, it will be appreciated that the rotation may also be continuous or otherwise rotated for distributing the composite materials uniformly within the fluid 14 for dispensing the fluid 14. In order to control the rotation of the syringe barrel 12, a control unit 29, such as a CPU, may be operatively connected to the motorized drive unit 26 for directing the motorized drive unit 26 to rotate the syringe barrel 12. However, it will be appreciated that any suitable mechanical structure or electronic controls for directing the motorized drive unit 26 to rotate the syringe barrel 12 may be used. Furthermore, the motorized drive unit 26 is adjustable relative to the dispensing valve 22 for accommodating the syringe barrel 12.

Figure 2:
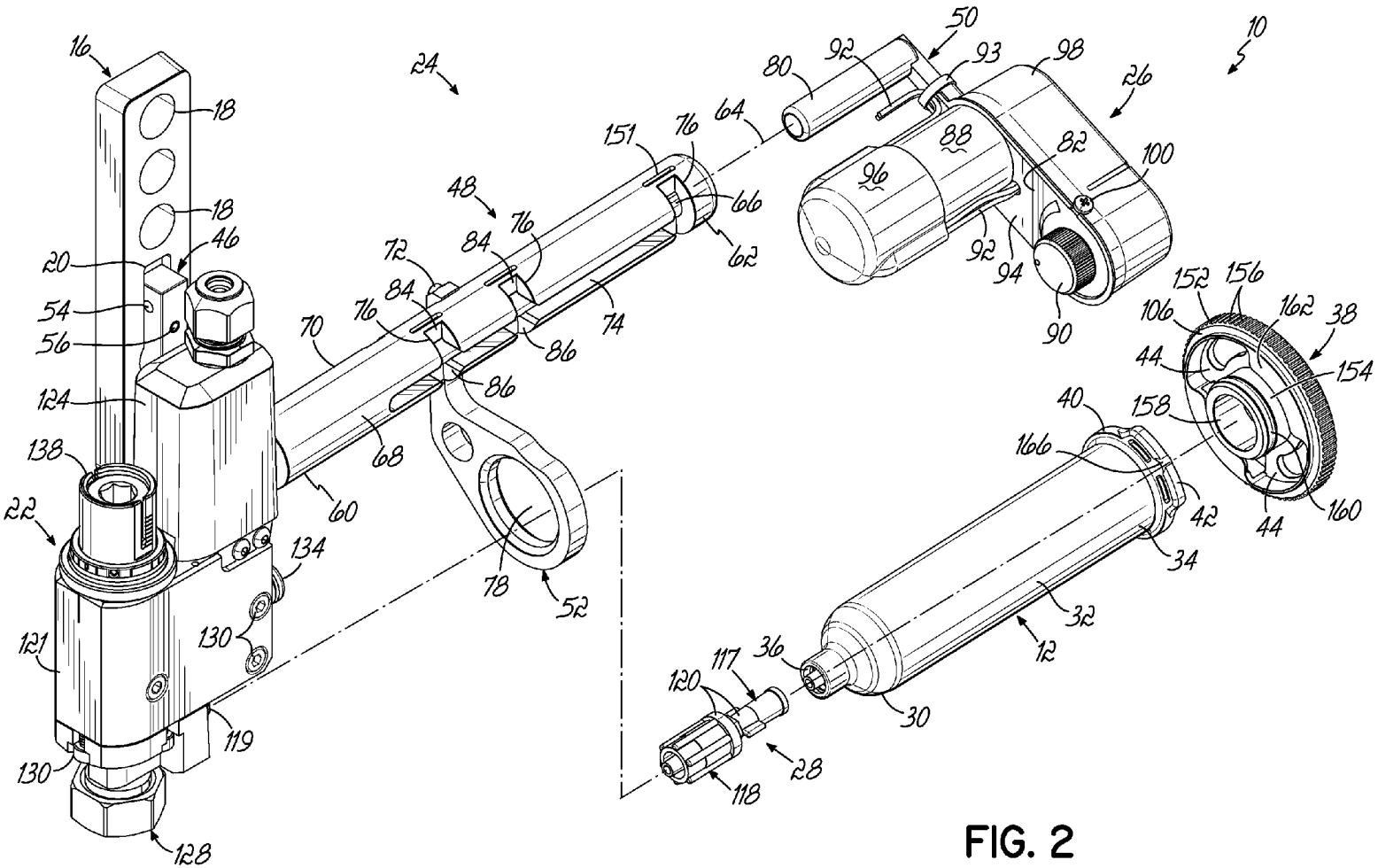
FIG. 2 is an exploded perspective view of FIG. 1.

FIG. 2 shows an exploded perspective view of one embodiment of the invention. The syringe barrel 12 for use with the fluid dispenser 10 further includes a front barrel portion 30, a central barrel portion 32 for holding the majority of the fluid 14, and a rear barrel portion 34. The front barrel portion 30 includes a male luer lock 36 for connecting to the coupling 28 in fluid communication with the dispensing valve 22. In contrast, the rear barrel portion 34, opposite the front barrel portion 30, is adapted for connecting a barrel adapter 38. More particularly, the rear barrel portion 34 includes a circumferential collar 40 with a pair of protruding tabs 42. The tabs 42 are configured to lockingly engage the barrel adapter 38 upon insertion into a pair of tab recesses 44 within the barrel adapter 38. Additional details concerning the locking engagement of the barrel adapter 38 to the syringe barrel 12 are described below (see FIGS. 6A-6B). While the present embodiment mounts the barrel adapter 38 to the rear barrel portion 34 as stated herein, it will be appreciated that the barrel adapter 38 may be mounted with fasteners or any other known structure adapted to fasten the barrel adapter 38 to the syringe barrel 12.

The support frame 24 for rotatably supporting the syringe barrel 12 also supports the motorized drive unit 26. The support frame 24 generally includes a core frame member 46, a primary support member 48, a motor support member 50, and a barrel support member 52. As shown in the present embodiment in FIG. 2 and in greater detail in FIG. 3, the core frame member 46 is mounted to the frame member 16 and between both the dispensing valve 22 and the primary support member 48. As such, the core frame member 46 is adapted to be the foundational structure from which the fluid dispenser 10 is mounted to the frame member 16 or any like structure in a manufacturing facility or similar environment. With respect to FIG. 2, the core frame member 46 is mounted within the mounting slot 20 of the frame member 16. Furthermore, the core frame member 46 includes a plurality of mounting holes 54 to which a plurality of fasteners 56 may be used for mounting various components. The plurality of mounting holes 54 are spaced throughout the core frame member 46 so that the core frame member 46 can be adapted to various component mounting locations and/or configurations as desired in the manufacturing facility.

Figure 3:
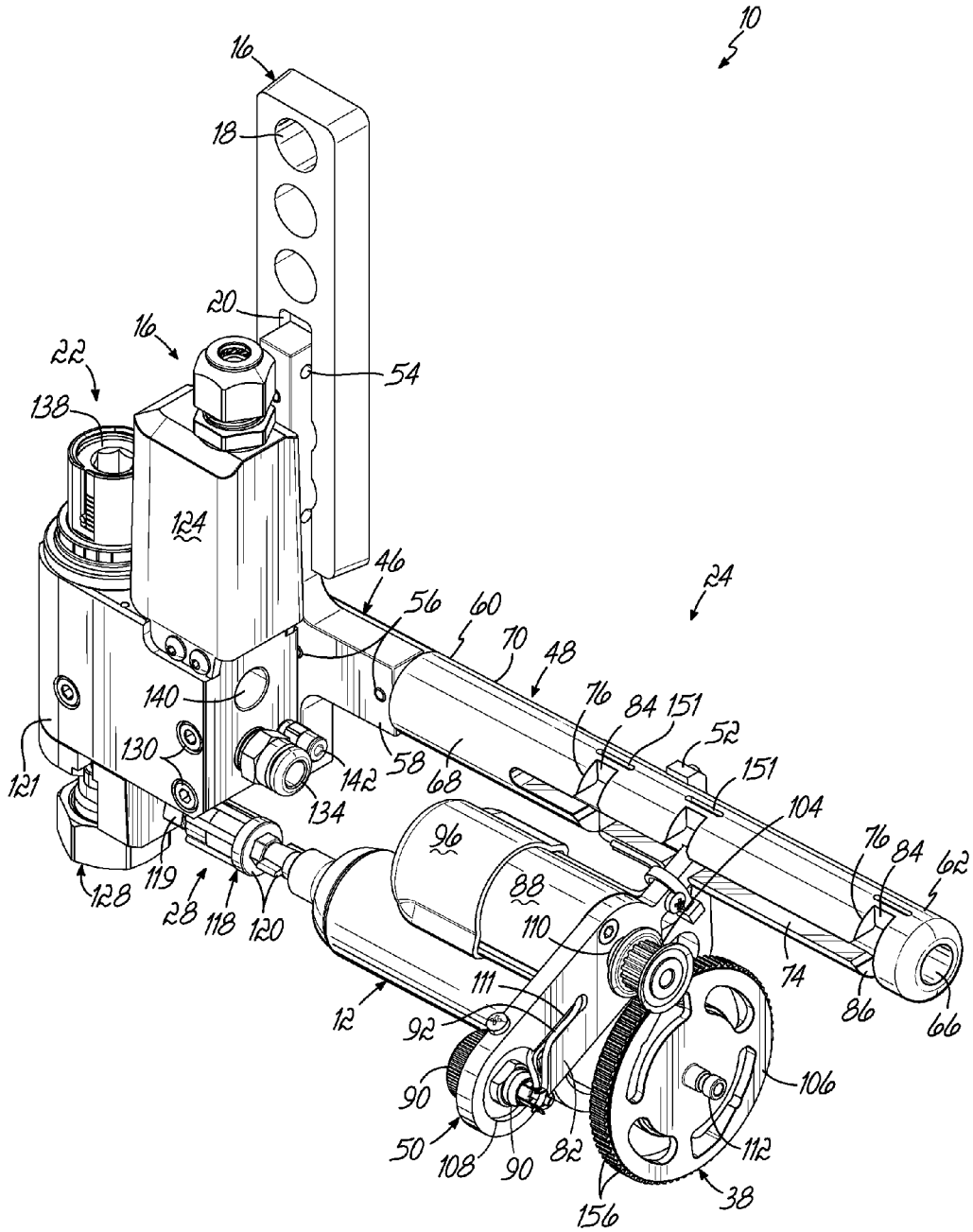
FIG. 3 is a rear perspective view of the fluid dispenser of FIG. 1 with the shield cover removed.

The core frame member 46 also includes a longitudinal portion 58, as shown in FIG. 2 and in more detail in FIG. 3. The longitudinal portion 58 extends longitudinally from the dispensing valve 22 to the primary support member 48. The primary support member 48 is cylindrically shaped and extends further in the longitudinal direction from a proximal end portion 60 adjacent to the core frame member 46 to a distal end portion 62 along a longitudinal axis 64. Furthermore, a guide bore 66 extends through the primary support member 48 along the length of the longitudinal axis 64.

In addition, the primary support member 48 has a front portion 68 directed toward the mounting position of the syringe barrel 12 and a rear portion 70 directed away from mounting position of the syringe barrel 12. The barrel support member 52 is mounted to the primary support member 48 at the rear portion 70 with a plurality of barrel support fasteners 72. The mounting of the barrel support member 52 to the primary support member 48 is also adjustable along the longitudinal axis 64 in order to accommodate syringe barrels 12 of variable size and volume.

As shown in FIGS. 2-3, the motor support member 50 is adjustably mounted to the primary support member 48 adjacent to the front portion 68. The front portion 68 includes a longitudinal channel 74 along the longitudinal axis 64 that extends through the front portion 68 to the guide bore 66. Furthermore, the front portion 68 includes a plurality of notches 76 positioned along the length of the longitudinal axis 64 that extends transversely through the longitudinal channel 74. Each notch 76 is adapted to be a position in which the motor support member 50 may be adjustably mounted in order to accommodate syringe barrels 12 of variable size and volume.

The barrel support member 52 is configured to rotatably support the syringe barrel 12 for coupling with the dispensing valve 22. More particularly, the barrel support member 52 is generally L-shaped so that the barrel support member 52 extends from its position at one end mounted to the rear portion 70 and around the primary support member 48 to a syringe barrel holder 78 in alignment with the coupling 28. According to the present embodiment, the syringe barrel holder 78 is defined by a hole through the barrel support member 52 sized to accommodate the syringe barrel 12 and may be available having different diameters to accommodate syringe barrels 12 of variable size and volume. The syringe barrel 12 may thus be rotatably mounted to the support frame 24 in alignment with the coupling 28. Furthermore, the syringe barrel holder 78 is rounded to promote smooth rotation of the syringe barrel 12 during use.

The motor support member 50 is adjustably mounted to the primary support member 48 through the longitudinal channel 74 at the guide bore 66. The motor support member 50 is defined by a guide pin 80 attached to a mounting plate 82 by a guide fastener 83 (see FIG. 5A or 5B). The guide pin 80 is sized to fit within the guide bore 66 and operatively slide along the longitudinal axis 64. The mounting plate 82 attached to the guide pin 80 extends from the guide bore 66, through the longitudinal channel 74, and outward from the primary support member 48. In addition, the motorized drive unit 26 is mounted to the motor support member 50. As such, the motorized drive unit 26 may be adjusted along the length of the longitudinal channel 74 to accommodate syringe barrels 12 of variable size and volume.

In order to adjustably mount the motor support member 50 in a fixed position, the mounting plate 82 drops, or is otherwise positioned, into any one of the plurality of notches 76. Each notch 76 includes an upper notch portion 84 and a lower notch portion 86. On one hand, the motor support member 50 is positioned in the lower notch portion 86 so that the motorized drive unit 26 mounted thereto may operatively engage the syringe barrel 12. On the other hand, the motor support member 50 is positioned in the upper notch portion 84 to operatively disengage the motorized drive unit 26 from the syringe barrel 12 and increase clearance between the motorized drive unit 26 and the syringe barrel 12. As such, installation and removal of the replacement syringe barrel 12 may be simplified with the increased clearance.

The motorized drive unit 26 generally includes an electric motor 88 operatively coupled to a speed control 90 by electrical wires 92 that are operatively coupled to a power source (not shown). The speed control 90 may be operated independently or in conjunction with the control unit 29 for directing the rotation of the syringe barrel 12 as described in more detail below. A wire retainer 93 is tightened onto the wires 92 and motor support member 50 for holding the wires adjacent to the motor support member 50. As shown in the present embodiment, the electric motor 88 and the speed control 90 are mounted to a front face 94 of the motor support member 50 and are accessible for use via the front face 94. However, it will be appreciated that the electric motor 88 and the speed control 90 may be mounted in any operative arrangement to the motor support member 50. The speed control 90 selectively operates the speed of the electric motor 88 for adjusting the speed of the rotation of the syringe barrel 12. Furthermore, the motorized drive unit 26 also includes a motor cover 96 and a shield cover 98 mounted to the motor support member 50 with a plurality of motor unit fasteners 100 in order to prevent unintended contact with moving components.

FIG. 3 shows a rear perspective view of the fluid dispenser 10 with the shield cover 98 removed from the motorized drive unit 26. This exposes a rear face 102 of the motor support member 50, a driving member 104 operatively coupled to the electric motor 88, and a driven member 106, which is defined by a portion of the barrel adapter 38. The motor support member 50 includes a speed control bore 108, a motor shaft bore 110, and a wire groove 111 extending through the front and rear faces 94, 102 that is adapted to further mount the speed control 90, the electric motor 88, and the electric wires 92 to the motor support member 50. While the support frame 24 includes the core frame member 46, the primary support member 48, the motor support member 50, and the barrel support member 52, it will be appreciated that various configurations of structure may be used as described herein. As such, the support frame 24 is not intended to be limited to the present embodiment.

The electric motor 88 rotatably drives the driving member 104, which, in turn, operatively drives the driven member 106. As shown in the present embodiment, the driving member 104 directly engages the driven member 106 in order to rotate the driven member 106. In addition, both the driving member 104 and the driven member 106 are gears; however, it will be appreciated that any method of operatively engaging the driving member 104 and driven member 106 may be used.

As discussed above, the driven member 106 is defined by the barrel adapter 38. Thus, as the driven member 106 rotates, so too does the barrel adapter 38. Given that the barrel adapter 38 is rigidly affixed to the syringe barrel 12, the barrel adapter 38 directly rotates the syringe barrel 12 for maintaining the uniform distribution of composite materials within the fluid 14.

Figure 4:
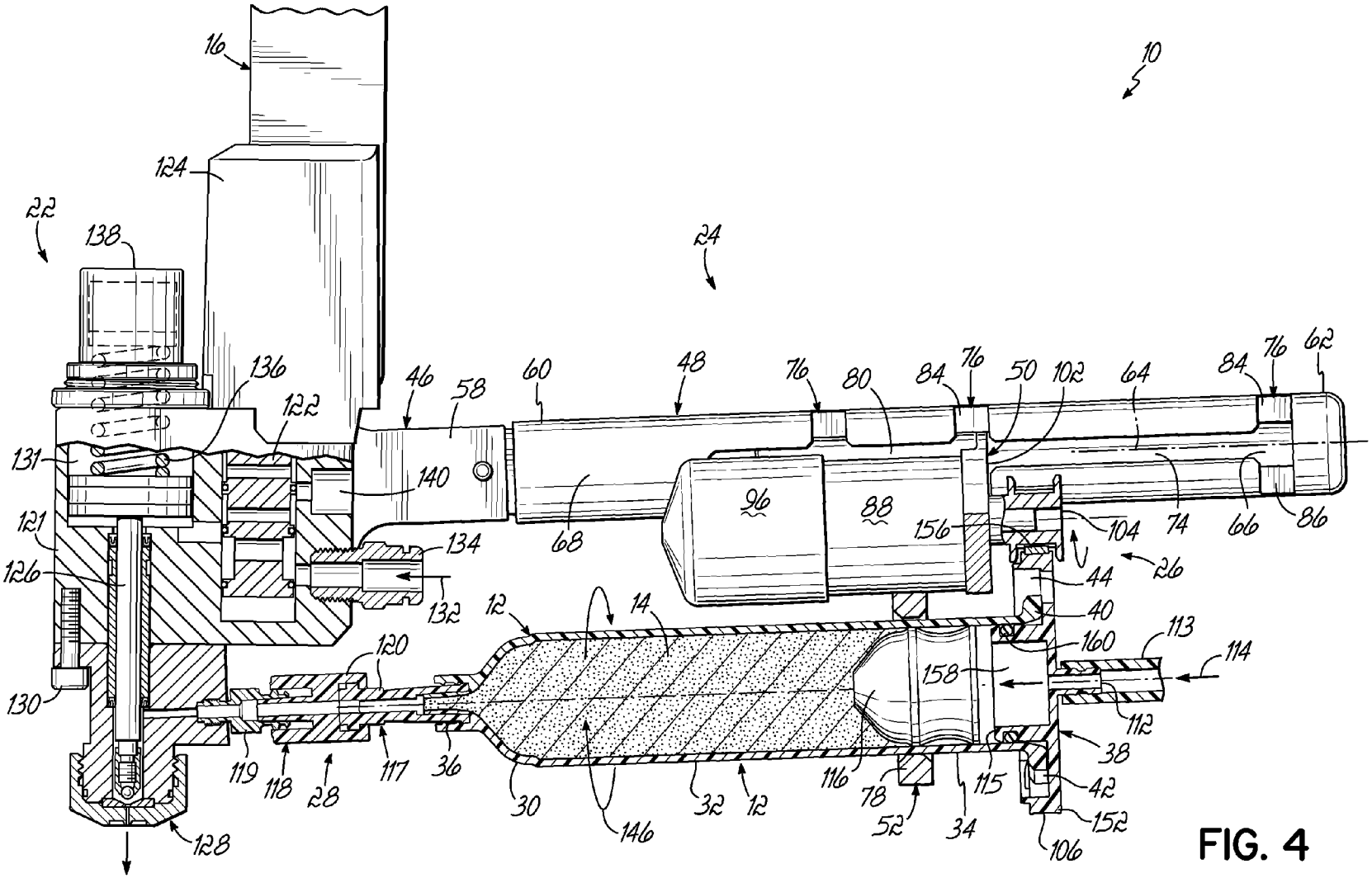
FIG. 4 is a schematic cross sectional view taken generally on the central axis of the syringe barrel for use with the fluid dispenser of FIG. 1.

As shown in FIGS. 3-4, the barrel adapter 38 also includes a supply fitting 112 in fluid communication with the interior of the syringe barrel 12. A rotatable supply coupling 113 is attached to the supply fitting 112 at one end and operatively connected to an air supply (not shown) at another end for delivering a first pressurized air, indicated by arrows 114, into the interior of the syringe barrel 12. One example of such a supply coupling 113 is shown in U.S. Pat. No. 7,448,653, the description of which is incorporated by reference herein. The supply coupling 113 permits the syringe barrel 12 to rotate continuously in any one direction. In the alternative, a non-rotatable supply coupling may also be used; however, the syringe barrel 12 will be generally limited to rotating back and forth. As such, the barrel adapter 38 defines a rear wall 115 of the syringe barrel 12 so that the first pressurized air 114 is sealed therein to force a barrel piston 116 from the rear barrel portion 34 toward the front barrel portion 30. This movement of the barrel piston 116 causes the fluid 14 to dispense from the syringe barrel 12, through the coupling 28, and into the dispensing valve 22.

The coupling 28 includes a pivot portion 117, which rotates with the syringe barrel 12, and a stationary portion 118, which is fixed to the stationary dispensing valve 22. Thereby, the coupling 28 is adapted for fluidly connecting the rotating syringe barrel 12 to the stationary dispensing valve 22. More particularly, the coupling 28 includes an adapter 119 and a rotatable luer connector 120. One such luer connector 120 is manufactured by Smiths Medical under the part number B1497HP. The adapter 119 is threaded at one end and provides a female luer lock at the other end for connecting the luer connector 120 thereto. The luer connector 120 has a male luer lock at one end for connecting to the female luer lock of the adapter 119. Another end of the luer connector 120 has a female luer lock that is adapted to be rotatable relative to the male luer lock end of the luer connector 120. Thus, the female luer lock end of the luer connector 120 is connected to the syringe barrel 12 to define the pivot portion 117. Furthermore, the male luer lock end of the luer connector 120 and the adapter 119 define the stationary portion 118.

The dispensing valve 22 generally includes a dispenser housing 121, an actuator 122 operatively connected to a solenoid valve 124, and a piston assembly 126 in fluid communication with a nozzle module 128. The solenoid valve 124 and the nozzle module 128 include built-in threads for a self-fastening assembly. A plurality of dispenser fasteners 130 extend through the dispensing valve 22 to the frame member 46 for mounting the dispensing valve 22 to the frame member 46. The piston assembly 126 extends within a piston bore 131 of the dispenser housing 121 and the nozzle module 128. In addition, the actuator 122 extends within the solenoid valve 124 and the dispenser housing 121. According to the present embodiment, the dispensing valve 22 receives a second pressurized air, as indicated by arrow 132, through an air input coupling 134. The second pressurized air 132 passes through the actuator 122 to force the piston assembly 126 against a biasing spring 136 held in position by a set screw assembly 138 attached to the dispenser housing 121.

As the piston assembly 126 is biased against the spring 136, the fluid 14 having the composite materials, such as a fluid and particulate material or two different fluids, being uniformly distributed therein, is dispensed into the nozzle module 128 operatively connected to the piston assembly 126. Once the nozzle 128 is sufficiently full of fluid 14, the solenoid valve 124 actuates the actuator 122 so that the spring 136 biases the piston assembly 126 operatively against the fluid 14 to dispense the fluid 14 from the fluid dispenser 10. The second pressurized air 132 is operatively dispensed from the fluid dispenser 10 through an exhaust port 140. Furthermore, the nozzle module 128 is also operatively connected to pressurized air via a nozzle air input port 142 to aid in the dispensing of fluid 14. While the dispensing valve 22 shown is a non-contact jetting valve system, it will be appreciated that any dispensing valve 22 for dispensing fluid 14 may be used. For example, such valves include, but are not limited to, contact jetting valve systems, piezo-actuated valves, time-pressure system valves, spray system valves, positive displacement system valves, auger valves, and gate/slider valves.

As shown in FIG. 4, the driving member 104 is rotatable, as indicated by arrows 144, for rotating the syringe barrel 12 counterclockwise from the perspective of the dispensing valve 22, as indicated by arrows 146. However, it will be appreciated that the syringe barrel 12 may also be rotated clockwise or any combination of clockwise and counterclockwise to distribute the composite materials uniformly within the fluid 14. As discussed above, the support frame 24 is configured to support the syringe barrel 12 in a generally horizontal position. However, any general position with a horizontal component for effectively uniformly distributing the composite materials within the fluid 14 may be used. According to the present embodiment, the syringe barrel 12 is supported approximately 2.5° from the horizontal so that the front barrel portion 30 is slightly lower than the rear barrel portion 34. Furthermore, the orientation or rotation may vary depending on the multi-component fluid for use with the fluid dispenser 10. While the present embodiment is a silicone encapsulent fluid including fluorescent material, other types of fluid may include, but are not limited to, marking inks or solid braze paste.

Figure 5A:
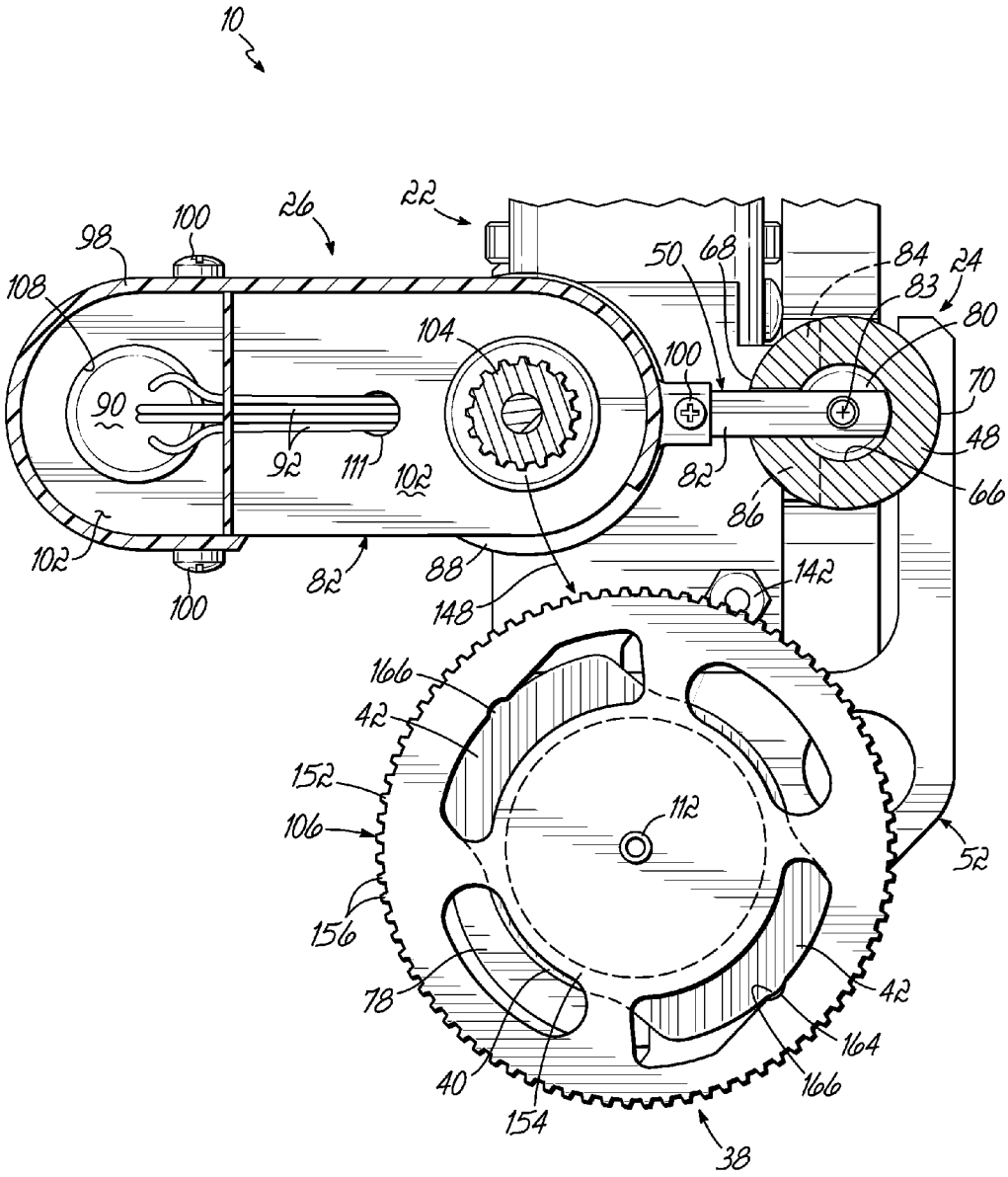
FIG. 5A is a partial cross sectional rear view of the fluid dispenser of FIG. 1 showing a driving gear disengaged from a driven gear.
Figure 5B:
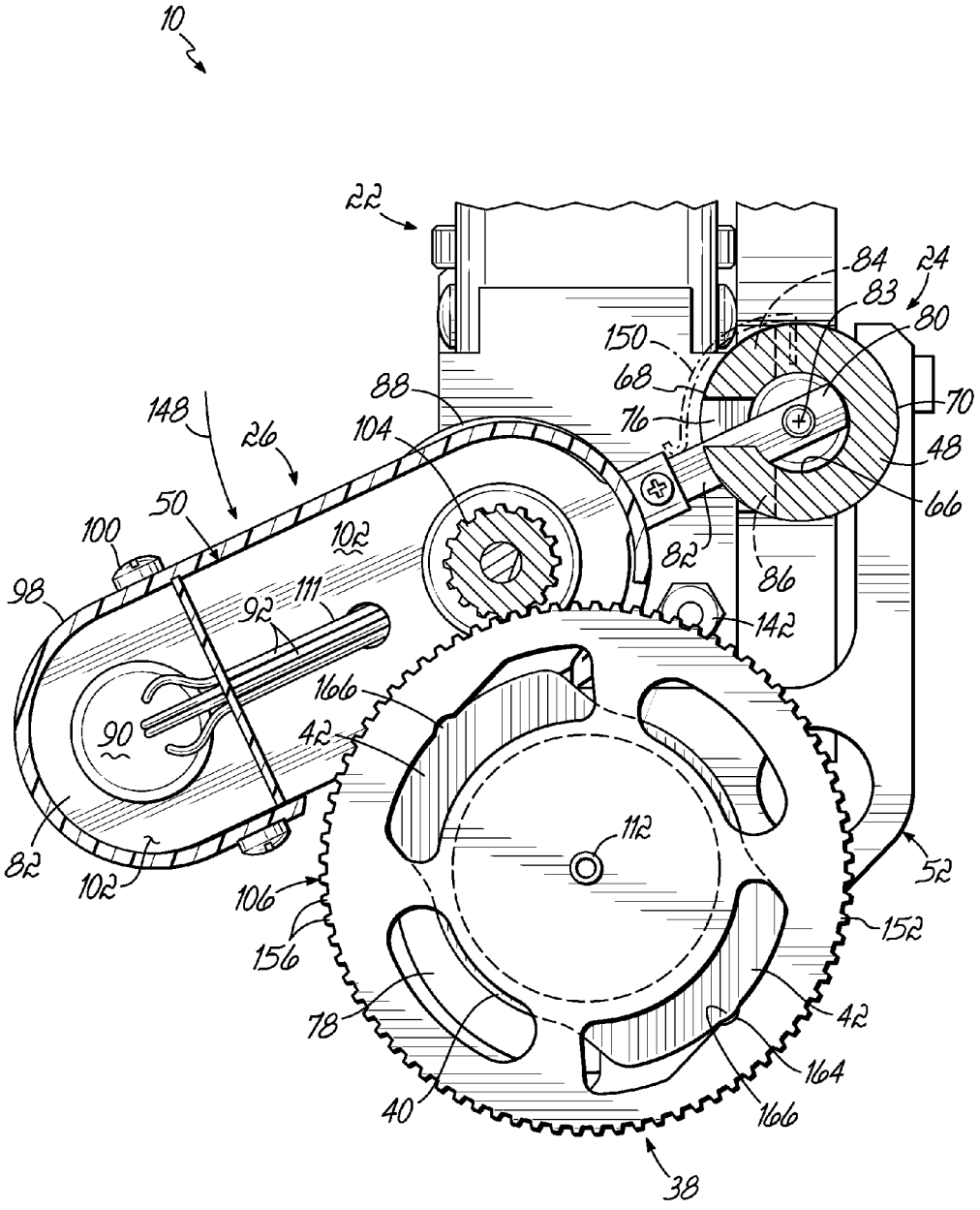
FIG. 5B is a partial cross sectional rear view of the fluid dispenser of FIG. 1 showing the driving gear engaging the driven gear.

FIGS. 5A-5B show the present embodiment of the motorized drive unit 26 moving relative to the barrel adapter 38 between a disengaged position to an engaged position. More particularly, as shown in FIG. 5A, the guide pin 80 is rotatably positioned within the guide bore 66 such that the mounting plate 82 is aligned with the longitudinal channel 74. As shown in FIG. 5B, the mounting plate 82 is aligned with any one of the lower notch portions 86 for pivoting, as indicated by arrow 148. More particularly, the motor support member 50 with the attached motorized drive unit 26 pivots toward the barrel adapter 38 until the driving member 104 engages the driven member 106.

Moreover, the motor support member 50 may further include a biasing element 150 as shown schematically in FIG. 5B. The biasing element 150 may be adapted to increase operative engagement between the driving member 104 and the driven member 106. The biasing element 150 may further be mounted within a biasing groove 151 on the top of the support frame 24 (see FIGS. 1-3). It will be appreciated, however, that any structure for biasing the drive member 104 to the driven member 106 may be used, and is not limited to, the embodiment shown schematically in FIG. 5B.

Figure 6A:
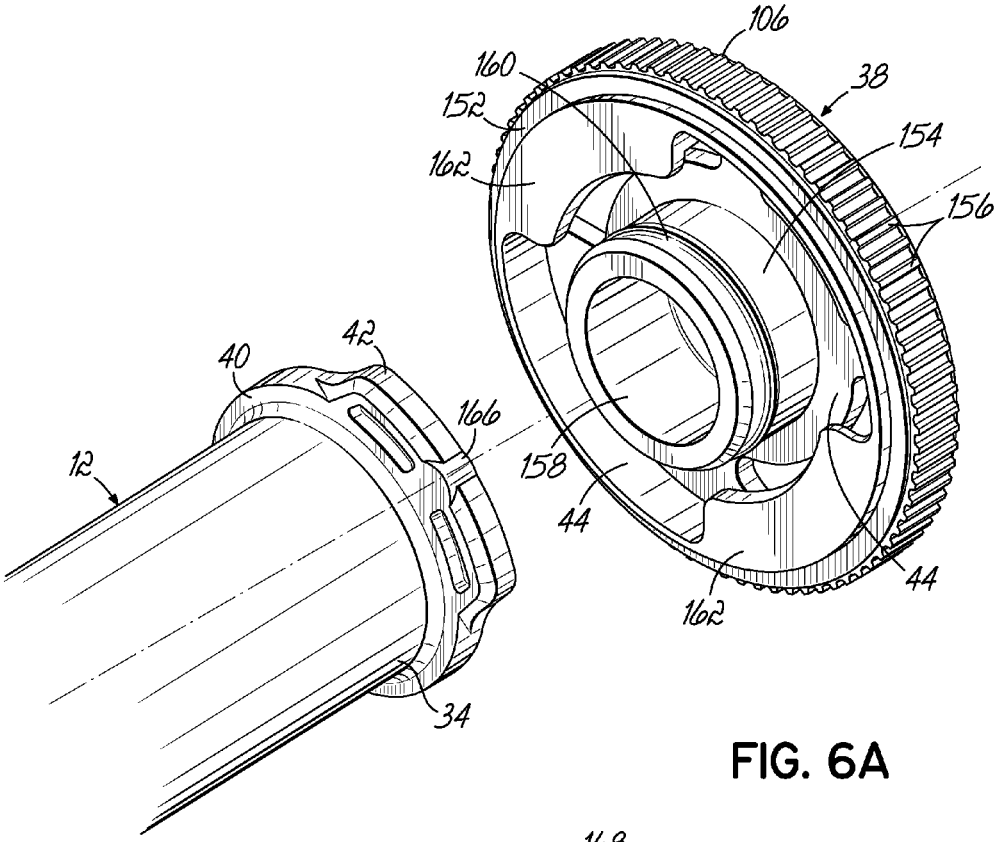
FIG. 6A is an exploded perspective view of a rear barrel portion of the syringe barrel and the barrel adapter shown in FIG. 1.
Figure 6B:
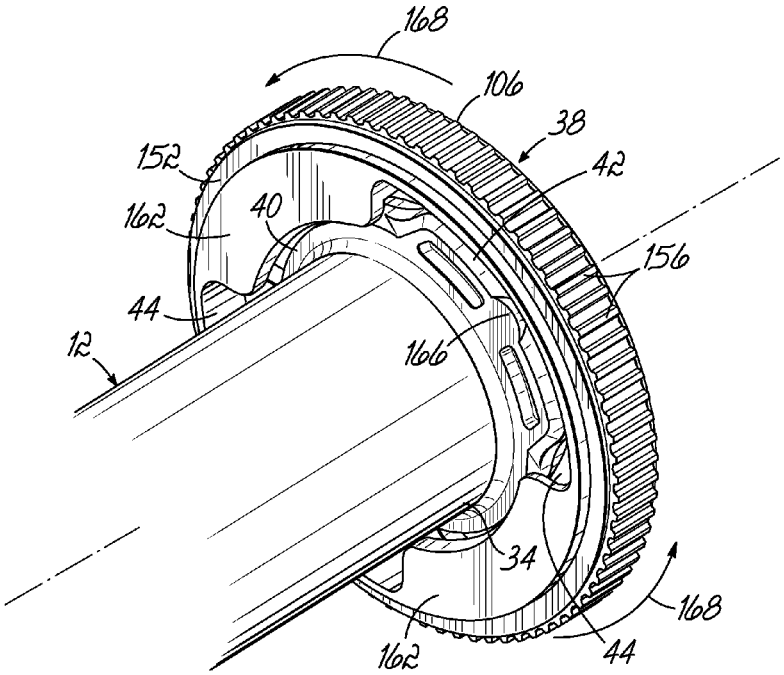
FIG. 6B is a perspective view of the rear barrel portion of the syringe barrel and the barrel adapter shown in FIG. 1 with the barrel adapter being rotatably installed on the rear barrel portion of the syringe barrel.
Figure 6C:
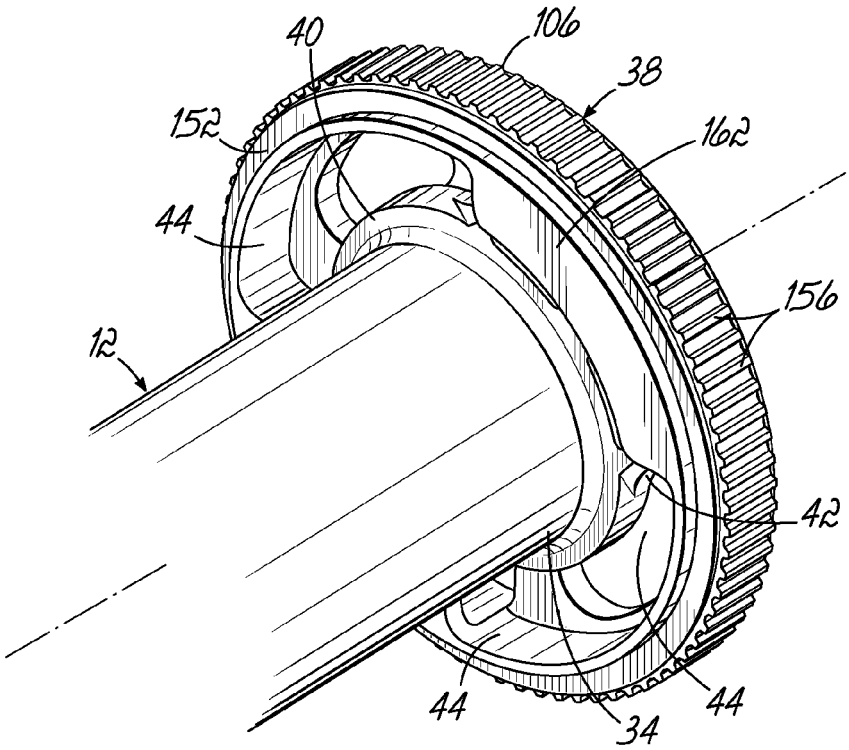
FIG. 6C is a perspective view of the rear barrel portion of the syringe barrel and the barrel adapter shown in FIG. 1 with the barrel adapter installed on the rear barrel portion of the syringe barrel.

FIGS. 6A-6C show the barrel adapter 38 and the rear barrel portion 34 of the syringe barrel 12. Generally, the barrel adapter 38 is an annular disk having an outer portion 152 and an inner portion 154. According to the present embodiment, the outer portion 152 defines the driven member 106 and includes a plurality of gear teeth 156 circumscribing the entirety of the outer portion 152. Furthermore, the outer portion 152 is adapted to lockingly receive the tab recesses 44 while the inner portion 154 is adapted to seal the rear barrel portion 34 for use with the fluid dispenser 10. For instance, the present embodiment of the barrel adapter 38 shows the inner portion 154 including a protrusion 158 with an o-ring seal 160 surrounding the protrusion 158. The inner portion 154 also includes the supply coupling 112 defining a hole therethrough (see FIG. 4).

More specifically, the outer portion 152 includes the tab recesses 44, a pair of tab flanges 162, and a detent groove 164 (see FIGS. 5A-5B). The tab recesses 44 are adapted to receive the tabs 42 of the syringe barrel 12 as shown in FIG. 6B. Furthermore, the tabs 42 each include a detent 166. Once the tabs 42 are inserted into the tab recesses 44, the barrel adapter 38 is forcibly rotated relative to the syringe barrel 12 until each detent 166 is fitted against each detent groove 164, as indicated by arrows 168. Thereby, the barrel adapter 38 lockingly engages the syringe barrel 12 and the inner portion 154 seals the rear barrel portion 34 for containing the first pressurized air 114 delivered via the air supply line 113. Once the barrel adapter 38 is sealed to the rear barrel portion 34 by the o-ring seal 160, the inner portion 154 defines the rear wall 115 of the syringe barrel 12.

With respect to FIGS. 1 through 6C, the method of dispensing the fluid 14 with a fluid dispenser 10 for use with the syringe barrel 12 includes coupling the syringe barrel 12 to the dispensing valve 22 such that the syringe barrel 12 and the dispensing valve 22 are in fluid communication. The syringe barrel 12 and the dispensing valve 22 are coupled by inserting the male luer lock 36 into the pivot portion 117 of the coupling 28 and connecting the stationary portion 118 of the coupling 28 to the dispensing valve 22.

The syringe barrel 12 is aligned with the coupling 28 by mounting the syringe barrel 12 rotatably to the support frame 24. Depending on the size and/or volume of the syringe barrel 12, the support frame 24 may be adjusted relative to the dispensing valve 22 in order to accommodate various sizes of syringe barrels 12. More particularly, the barrel support member 52 is adjusted to rotatably support the syringe barrel 12 for aligning the syringe barrel 12 to the dispensing valve 22. Also, the barrel adapter 38 is rotatably installed onto the rear portion 70 of the syringe barrel 12 by lockingly engaging the detents 166 to the detent grooves 164. Thus, the motor support member 50 is adjusted so that the motorized drive unit 26 mounted thereto operatively engages the barrel adapter 38 to rotate the syringe barrel 12.

The syringe barrel 12 is rotated for maintaining the uniformly distributed composite materials within the fluid 14. Such rotation of the syringe barrel 12 may include periodic rotation, continuous rotation, or any combination of periodic and continuous rotation. In any case, the control unit 29 directs the motorized drive unit 26 to rotate the syringe barrel 12 at some speed and/or in some periodic time interval in order to promote the uniform distribution of higher density materials relative to the lower density materials under the influence of gravity.

Periodic rotation includes stopping and starting the rotation of the syringe barrel 12 in periodic intervals. For example, periodic rotations may occur in odd-number multiples of generally 180°. Such odd-number multiples for periodic rotation may be generally 180°, 540°, 900°, and so forth. The direction of the periodic rotation may be in one direction, such as the counterclockwise direction or the clockwise direction, or the direction may be back and forth between the clockwise and counterclockwise directions in periodic rotations. For example, the syringe barrel 12 may rotate in one direction, such as the counterclockwise direction, in periodic intervals of 180°. Similarly, the syringe barrel 12 may rotate counterclockwise in a periodic interval of 180° and then rotate back in the clockwise direction in another periodic interval of 180°. Moreover, a time for the periodic interval is selected that is optimized for maintaining the uniform distribution of composite materials under the influence of gravity. The time for each of the periodic intervals may be the same or variable. More specifically, according to the present embodiment, the syringe barrel 12 may be repeatedly rotated between 1 and 2 revolutions every 6 to 18 seconds. Even more specifically, the syringe barrel 12 may be repeatedly rotated periodically approximately 1.5 revolutions generally every 12 seconds.

The rotation of the syringe barrel 12 may also be continuous. Generally, continuous rotation is non-stop, 360° rotation of the syringe barrel 12 in either the counterclockwise or clockwise direction. Moreover, a rotational speed is selected that is optimized for maintaining the uniform distribution of composite materials under the influence of gravity. The rotational speed of the syringe barrel 12 may be constant or variable. For example, the syringe barrel 12 may rotate at approximately 5 revolutions per minute continuously.

The rotation of the syringe barrel 12 may also be any combination of full and/or partial rotations occurring in periodic intervals in the counterclockwise and/or clockwise direction. Accordingly, both the rotational speeds and periodic intervals may be optimized for the fluid dispenser 10 to maintain the uniform distribution of the composite materials under the influence of gravity. It will be appreciated that the motor 88 may be operated directly or by a remote control (not shown) for starting, stopping, or reversing the rotation of the syringe barrel 12 over a wide range of speeds and/or periodic intervals. Thus, the rotation of the syringe barrel 12 is not intended to be limited to the exemplary embodiment described herein.

Furthermore, the fluid 14 is dispensed by the dispensing valve 22 by injecting the first pressurized air 114 through the supply coupling 112 in the barrel adapter 38. The first pressurized air 114 pressurizes the interior of the syringe barrel 12 for moving the barrel piston 116 against the fluid 14. Thereby, fluid 14 flows from the syringe barrel 12 and into the dispensing valve 22 for being dispensed.

Figure 7:
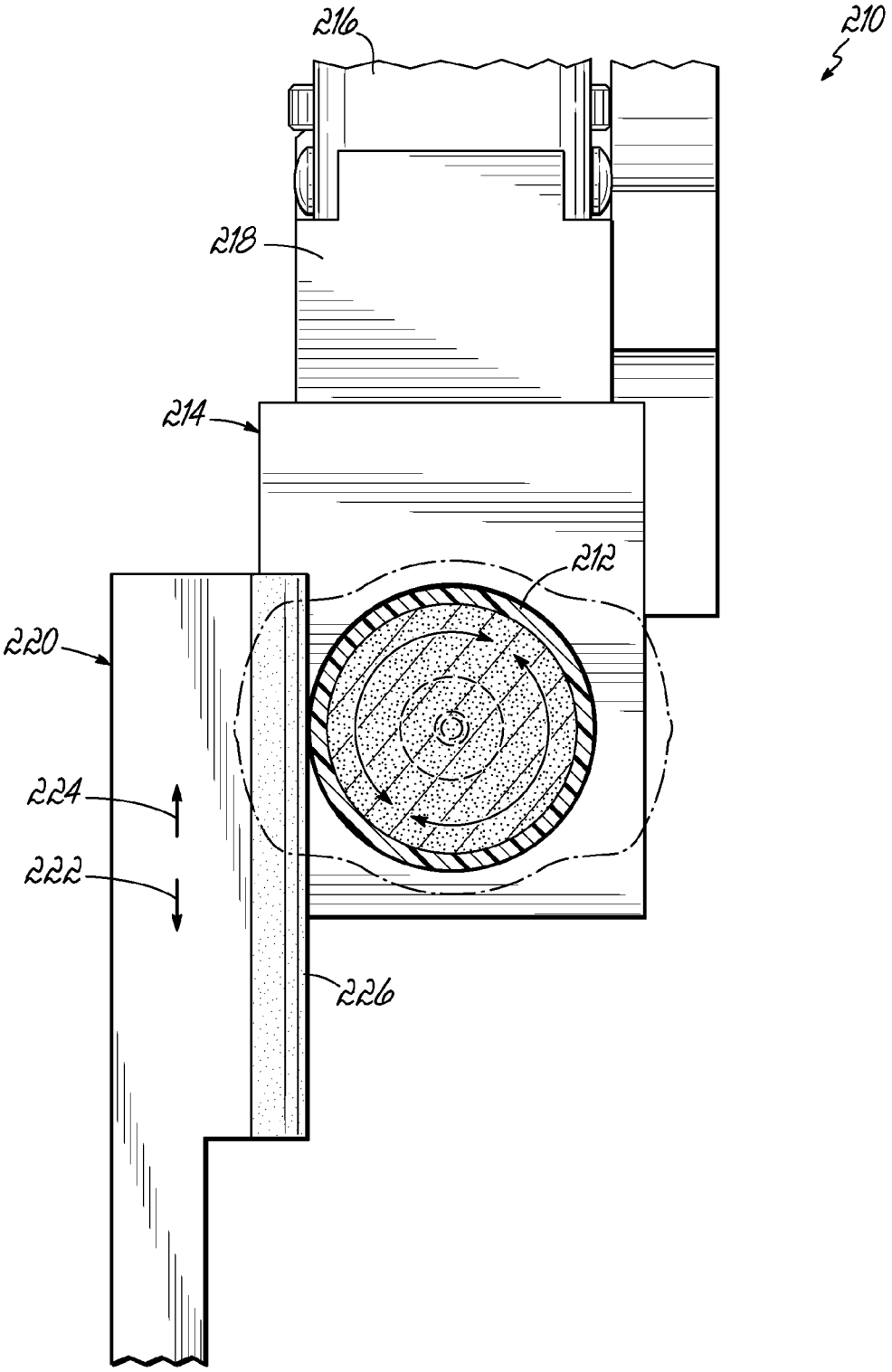
FIG. 7 is a rear view of a fluid dispenser for use with a syringe barrel holding a fluid including a distribution of composite materials according to a second embodiment of the invention.

FIG. 7 is a rear schematic view of a second embodiment of the fluid dispenser 210 for use with a syringe barrel 212 mounted to a frame member 214. The fluid dispenser 210 generally includes a dispensing valve 216 and a support frame 218 extending therefrom for supporting the syringe barrel 212. A motorized drive unit 220 is adapted to rotate the syringe barrel 212 by linearly actuating back and forth between a first direction and a second direction as indicated by arrows 222, 224 respectively. In addition, the motorized drive unit 220 may be operatively connected to the control unit 29 (see FIG. 1) in order to direct the rotation of the syringe barrel 212, as described above. For instance, the motorized drive unit 220 may rotate the syringe barrel 212 periodically between the first direction and the second direction in half-turn increments. As such, a driving member 226 of the motorized drive unit 220 is a friction bar that operatively engages the syringe barrel 212. In the alternative, the driving member 226 may be a gear rack that operatively engages a driven member (not shown), similar to driven member 106 shown in the embodiment of FIGS. 1-6C, connected to the syringe barrel 212.

According to the exemplary embodiment shown in FIG. 7, the motorized drive unit 220 is supported such that it is in engagement, i.e., in contact with the syringe barrel 212. In the alternative, either one or both of the frame member 214 and the driving member 226 may move relative to the other for providing selective engagement between the driving member 226 and the syringe barrel 212. With respect to engaging the syringe barrel 212, the frame member 214 may be stationary while the motorized drive unit 220 moves into engagement with the syringe barrel 212. Alternatively, the fluid dispenser 210 may further include a robot (not shown) while the motorized drive unit 220 may be replaced by a stationary element (not shown). This embodiment may be useful when a robot is used to position the dispensing valve 216 and syringe barrel 212 in one location to dispense fluid on a workpiece or substrate and then move the dispensing valve 216 and syringe barrel 212 to another location for rotation of the syringe barrel 212. Rotation of the syringe barrel 212 may be caused by the robot moving the syringe barrel 212 vertically along the stationary element.

Once the motorized drive unit 220 or stationary element is brought into engagement with the syringe barrel 212, relative motion between the frame member 214 and either the motorized drive unit 220 or stationary element operatively rotates the syringe barrel 212. In the case of the motorized drive unit 220, the motorized drive unit 220 linearly actuates against the syringe barrel 212 as described above. In the case of the stationary element, the robot linearly actuates the syringe barrel 212 against the stationary element and thereby serves as the motorized drive unit. In either case, the relative motion created by either the robot or the motorized drive unit 220 while engaging the syringe barrel 212 operatively rotates the syringe barrel 212. It will also be appreciated that either the motorized drive unit 220 or stationary element may include either a friction bar or a gear rack to engage and rotate the syringe barrel 212.

Figure 8:
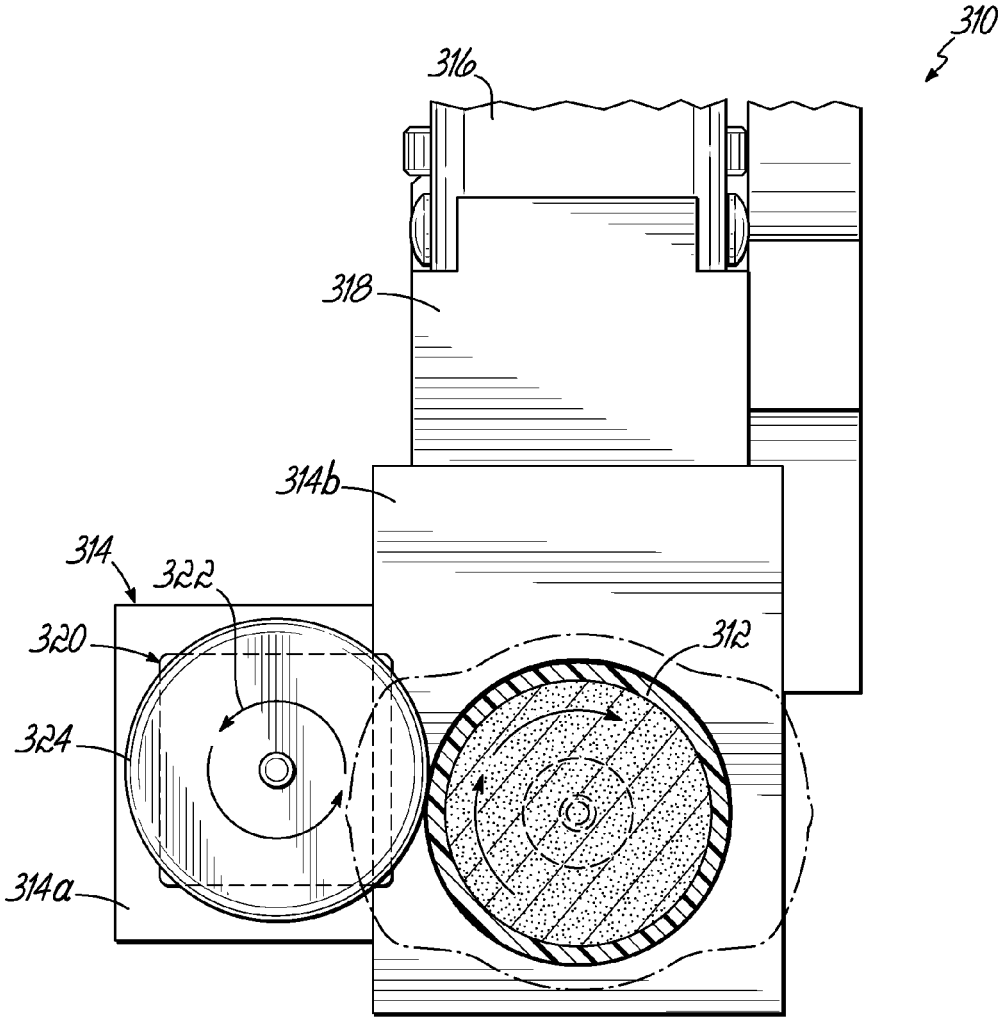
FIG. 8 is a rear view of a fluid dispenser for use with a syringe barrel holding a fluid including a distribution of composite materials according to a third embodiment of the invention.

FIG. 8 is a rear schematic view of a third embodiment of the fluid dispenser 310 for use with a syringe barrel 312 mounted to a frame member 314. The fluid dispenser 310 generally includes a dispensing valve 316 and a support frame 318 extending therefrom for supporting the syringe barrel 312. A motorized drive unit 320 is adapted to rotate the syringe barrel 312 by rotating a driving member as indicated by arrows 322. In addition, the motorized drive unit 320 may be operatively connected to the control unit 29 (see FIG. 1) in order to direct the rotation of the syringe barrel 312, as described above. As such, the driving member 324 of the motorized drive unit 320 is a friction plate that operatively frictionally engages the syringe barrel 312. It will be appreciated that any motorized drive unit 320 for causing the friction plate or gears (not shown) to rotate the syringe barrel 312 may be used.

The frame member 314 may support both the syringe barrel 312 and the motorized drive unit 320 in fixed positions for engaging and rotating the syringe barrel 312. As one alternative option, the frame member 314 may also be comprised of a frame element 314*a* that supports the motorized drive unit 320 and a separate frame element 314*b* that supports the syringe barrel 312. Accordingly, the fluid dispenser 310 may include a robot (not shown) to move at least either the syringe barrel 312 or the motorized drive unit 320 into frictional engagement with the other. For example, the frame element 314*b* and syringe barrel 312 may be in a fixed position and the robot would then move the frame element 314*a* and the attached motorized drive unit 320 into and out of engagement with the syringe barrel 312. Alternatively, the frame element 314*a* and motorized drive unit 320 may be in a fixed position and the robot would then move the frame element 314*b* and the attached syringe barrel 312 to engage the motorized drive unit 320.

While the present invention has been illustrated by the description of one or more embodiments thereof, and while the embodiments have been described in considerable detail, they are not intended to restrict or in any way limit the scope of the appended claims to such detail. Additional advantages and modifications will readily appear to those skilled in the art. The invention in its broader aspects is therefore not limited to the specific details, representative apparatus and method and illustrative examples shown and described. Accordingly, departures may be from such details without departing from the scope or spirit of the general inventive concept.

What is claimed is:

1. A fluid dispenser for use with a syringe barrel holding a fluid including a distribution of composite materials, comprising;

a dispensing valve operable to dispense the fluid;

a coupling connected to the dispensing valve for fluidly connecting the syringe barrel with the dispensing valve;

a support frame for rotatably supporting the syringe barrel generally adjacent to the dispensing valve in a generally horizontal orientation so as to align the syringe barrel with the coupling; and a motorized drive unit configured to rotate the syringe barrel to distribute the composite materials uniformly within the fluid.

2. The fluid dispenser of claim 1 wherein the coupling has a stationary portion and a pivot portion, the stationary portion being fixedly connected to the dispensing valve and the pivot portion for being fixedly connected to the syringe barrel, wherein the pivot portion is rotatable relative to the stationary portion for coupling the rotatably supported syringe barrel to the dispensing valve.

3. The fluid dispenser of claim 1 wherein the support frame is affixed to the dispensing valve and extends therefrom.

4. The fluid dispenser of claim 1 wherein the support frame is adjustable relative to the dispensing valve for accommodating syringe barrels of variable size.

5. The fluid dispenser of claim 1 wherein the motorized drive unit is adjustable relative to the dispensing valve for accommodating syringe barrels of variable size.

6. The fluid dispenser of claim 1 further comprising:

a driving member attached to the motorized drive unit, the driving member operatively rotatable by the motorized drive unit;

a driven member for attaching to the syringe barrel, wherein the driving member operatively engages the driven member for rotating the syringe barrel.

7. The fluid dispenser of claim 6 wherein the driven member is an annular disk for attaching to a rear portion of the syringe barrel, the annular disk having an outer portion and an inner portion, the outer portion being adjacent to the driving member and being adapted to operatively engage the driving member, the inner portion for defining a rear wall of the syringe barrel and being adapted to attach the driven member to the syringe barrel.

8. The fluid dispenser of claim 7 wherein the inner portion of the driven member includes an input port defined by a through hole, the input port being adapted for pressurizing the fluid within the syringe barrel.

9. The fluid dispenser of claim 7 wherein the driving member is a driving gear and the driven member is a driven gear, the driving gear directly engaging the driven gear.

10. The fluid dispenser of claim 1 wherein the speed of the motorized drive unit is selectively adjustable for controlling the rotational speed of the syringe barrel.

11. The fluid dispenser of claim 1 wherein the support frame includes a motor support member adjustable relative to the dispensing valve, the motorized drive unit being mounted to the adjustable motor support member for accommodating syringe barrels of variable size.

12. The fluid dispenser of claim 1 wherein the composite materials include a relatively high density material and a relatively low density material, the fluid dispenser further comprising a control unit operatively connected to the motorized drive unit, the control unit configured to direct the motorized drive unit to rotate the syringe barrel in periodic intervals to promote the uniform distribution of the high and low density materials under the influence of gravity.

13. A fluid dispenser for use with a syringe barrel holding a fluid including a distribution of composite materials, comprising;

a dispensing valve configured to dispense the fluid;

a coupling connected to the dispensing valve for fluidly connecting the syringe barrel with the dispensing valve, the coupling having a stationary portion and a pivot portion, the stationary portion being fixedly connected to the dispensing valve and the pivot portion for being fixedly connected to the syringe barrel such that the pivot portion is rotatable relative to the stationary portion for coupling the rotatably supported syringe barrel to the dispensing valve;

a support frame for supporting the syringe barrel generally adjacent to the dispensing valve in a generally horizontal orientation so as to align the syringe barrel with the coupling, the support frame being affixed to the dispensing valve and extending therefrom;

a driving member attached to a motorized drive unit, the driving member operatively rotatable by the motorized drive unit, a driven member for attaching to the syringe barrel;

wherein the driving member operatively engages the driven member for rotating the syringe barrel to distribute the composite materials uniformly within the fluid.

14. The fluid dispenser of claim 13 wherein the support frame is adjustable relative to the dispensing valve for accommodating syringe barrels of variable size.

15. The fluid dispenser of claim 13 wherein the motorized drive unit is adjustable relative to the dispensing valve for accommodating syringe barrels of variable size.

16. The fluid dispenser of claim 13 wherein the support frame further includes:

a primary support member operatively affixed to the dispensing valve;

a barrel support member adjustably mounted to the primary support member and configured to support the syringe barrel; and a motor support member adjustably mounted to the primary support member, the motorized drive unit being mounted to the motor support member, wherein the barrel support member and the motor support member are longitudinally adjustable along the primary support member for accommodating syringe barrels of various size.

17. The fluid dispenser of claim 13 wherein the composite materials include a relatively high density material and a relatively low density material, the fluid dispenser further comprising a control unit operatively connected to the motorized drive unit, the control unit configured to direct the motorized drive unit to rotate the syringe barrel in periodic intervals to promote the uniform distribution of the high and low density materials under the influence of gravity.

18. A method of dispensing a fluid with a fluid dispenser for use with a syringe barrel containing fluid having a distribution of composite materials, the fluid dispenser including a dispensing valve positioned relative to a support frame and a drive unit, the method comprising;

coupling the syringe barrel to the dispensing valve such that the syringe barrel and the dispensing valve are in fluid communication;

mounting the syringe barrel rotatably on the support frame with the syringe barrel in a generally horizontal orientation;

rotating the syringe barrel via the motorized drive unit to distribute the composite materials uniformly within the fluid; and dispensing the fluid including the uniformly distributed composite materials.

19. The method of claim 18 wherein rotating the syringe barrel further includes:

stopping and starting the rotation of the syringe barrel in periodic intervals.

20. The method of claim 19 further including:

repeating the rotating of the syringe barrel periodically in odd-number multiples of generally 180°.

21. The method of claim 18 further comprising:

adjusting the support frame relative to the dispensing valve to accommodate syringe barrels of variable size.

* * * * *